US009869942B2

(12) United States Patent
Fujita et al.

(10) Patent No.: US 9,869,942 B2
(45) Date of Patent: Jan. 16, 2018

(54) IMAGING APPARATUS AND PROCESS OF FORMING IMAGE WITH ELECTROPHOTOGRAPHIC PHOTORECEPTOR HAVING PROTECTIVE LAYER CONTAINING PARTICULATE P-TYPE SEMICONDUCTOR

(71) Applicant: Konica Minolta, Inc., Tokyo (JP)

(72) Inventors: Toshiyuki Fujita, Hachioji (JP); Keiichi Inagaki, Hino (JP); Kazuteru Ishizuka, Saitama (JP); Mari Ueda, Mitaka (JP); Daisuke Kodama, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/081,161

(22) Filed: Mar. 25, 2016

(65) Prior Publication Data

US 2016/0291525 A1 Oct. 6, 2016

(30) Foreign Application Priority Data

Mar. 30, 2015 (JP) ..... 2015-069055

(51) Int. Cl.
*G03G 5/00* (2006.01)
*G03G 15/00* (2006.01)
(Continued)

(52) U.S. Cl.
CPC ..... *G03G 5/147* (2013.01); *G03G 5/082* (2013.01); *G03G 5/08278* (2013.01);
(Continued)

(58) Field of Classification Search
CPC .. G03G 5/147; G03G 5/14704; G03G 15/751; G03G 2215/00957
(Continued)

(56) References Cited

U.S. PATENT DOCUMENTS 6,492,081 B2 * 12/2002 Morikawa ..... G03G 5/147 399/147
6,911,288 B2 * 6/2005 Goodbrand ..... G03G 5/0507 399/159
(Continued)

FOREIGN PATENT DOCUMENTS

JP 2006267299 A * 10/2006
JP 2008134467 A * 6/2008
(Continued)

OTHER PUBLICATIONS https://www.scribd.com/doc/199820570/Surface-Roughness-JIS-B-0601-2001; Surface Roughness (JIS B 0601-2001).*
(Continued)

*Primary Examiner* — Robert Beatty
(74) *Attorney, Agent, or Firm* — Lucas & Mercanti, LLP

(57) ABSTRACT

An imaging apparatus including: an electrophotographic photoreceptor; a charging unit to charge the surface of the electrophotographic photoreceptor; an exposing unit to perform exposure of the electrophotographic photoreceptor charged by the charging unit; a developing unit to feed a toner to the electrophotographic photoreceptor exposed by the exposing unit to form a toner image; a transfer unit to transfer the toner image formed on the electrophotographic photoreceptor; a lubricant feeding unit to feed a lubricant onto the surface of the electrophotographic photoreceptor; and a cleaning unit to remove the residual toner on the surface of the electrophotographic photoreceptor, wherein the electrophotographic photoreceptor includes a conductive support, a photoreceptive layer, and a protective layer disposed in sequence, the protective layer includes a resin containing a particulate P-type semiconductor, and the protective layer has a surface roughness Rz of 0.030 μm or more and 0.075 μm or less.

14 Claims, 3 Drawing Sheets

(51) Int. Cl.
*G03G 5/147* (2006.01)
*G03G 21/00* (2006.01)
*G03G 5/082* (2006.01)

(52) U.S. Cl.
CPC ..... *G03G 5/14704* (2013.01); *G03G 5/14791* (2013.01); *G03G 15/751* (2013.01); *G03G 21/0094* (2013.01); *G03G 2215/00957* (2013.01)

(58) Field of Classification Search
USPC ..... 399/159; 430/66
See application file for complete search history.

(56) References Cited

U.S. PATENT DOCUMENTS 7,232,633 B2 * 6/2007 Qi ..... G03G 5/047 430/58.8
9,436,108 B2 * 9/2016 Kodama ..... G03G 5/14791
2004/0265016 A1 * 12/2004 Kitani ..... G03G 13/013 399/298
2006/0115761 A1 * 6/2006 Itami ..... G03G 5/0507 430/122.1
2007/0048013 A1 * 3/2007 Tokutake ..... G03G 5/0503 399/159
2009/0067876 A1 * 3/2009 Seshita ..... G03G 9/0806 399/107
2013/0157182 A1 * 6/2013 Fujita ..... G03G 5/043 430/57.1
2016/0054668 A1 * 2/2016 Yumita ..... G03G 5/14713 430/66

FOREIGN PATENT DOCUMENTS

JP 2011075621 A 4/2011
JP 2014-021133 A 2/2014
JP 2014-186047 A 10/2014

OTHER PUBLICATIONS

Notification of Reasons for Refusal dated Apr. 4, 2017 from corresponding Japanese Patent Application No. 2015-069055; English translation of Notification of Reasons for Refusal: Total of 22 pages.

* cited by examiner

IMAGING APPARATUS AND PROCESS OF FORMING IMAGE WITH ELECTROPHOTOGRAPHIC PHOTORECEPTOR HAVING PROTECTIVE LAYER CONTAINING PARTICULATE P-TYPE SEMICONDUCTOR

BACKGROUND OF THE INVENTION

1. Field of the Invention

The present invention relates to imaging apparatuses and processes of forming images for forming electrophotographic images.

2. Description of Related Art

Electrophotographic photoreceptors included in electrophotographic imaging apparatuses (hereinafter, also simply referred to as "photoreceptors") are responsible for formation of images having stable quality. Photoreceptors having fine scratches or irregularities generated due to wear of their surfaces degrade image quality.

Accordingly, non-transferred toners remaining on the surface of the photoreceptor in such an electrophotographic imaging apparatus during an image forming process have been mechanically removed with a cleaning member. In addition, a lubricant has been applied onto the surface of the photoreceptor to form a coating of the lubricant on the surface of the photoreceptor. The coating of the lubricant reduces the frictional resistance between the photoreceptor and the cleaning member to prevent generation of fine scratches or irregularities caused by wear of the photoreceptor.

Furthermore, for example, a photoreceptor having a large surface roughness Rz to increase the amount of the lubricant to be applied onto the photoreceptor or to increase the lubricant present on the surface of the lubricant is proposed for a further enhancement in cleaning characteristics of the photoreceptor (for example, see Patent Literature 1: Japanese Patent Application Laid-Open No. 2011-75621).

Although such an imaging apparatus including a photoreceptor having a large surface roughness Rz disclosed in Patent Literature 1 increases the amount of the lubricant to be applied onto the photoreceptor, an excess lubricant accumulated on the surface of the photoreceptor readily causes fogging or blurring in images. Control of the amount of the lubricant has technical difficulties in formation of a coating of the lubricant on the surface of the photoreceptor.

SUMMARY OF THE INVENTION

The present invention has been made based on such circumstances. An object of the present invention is to provide an imaging apparatus and a process of forming an image which can have stable cleaning characteristics for a long time and enables formation of images having highly stable quality.

An imaging apparatus according to the present invention includes an electrophotographic photoreceptor; a charging unit to charge the surface of the electrophotographic photoreceptor; an exposing unit to perform exposure of the electrophotographic photoreceptor charged by the charging unit; a developing unit to feed a toner to the electrophotographic photoreceptor exposed by the exposing unit to form a toner image; a transfer unit to transfer the toner image formed on the electrophotographic photoreceptor; a lubricant feeding unit to feed a lubricant onto the surface of the electrophotographic photoreceptor; and a cleaning unit to remove the residual toner on the surface of the electrophotographic photoreceptor, wherein the electrophotographic photoreceptor includes a conductive support, a photoreceptive layer, and a protective layer disposed in sequence, the protective layer includes a resin containing a particulate P-type semiconductor, and the protective layer has a surface roughness Rz of 0.030 μm or more and 0.075 μm or less.

An imaging apparatus according to the present invention includes an electrophotographic photoreceptor; a charging unit to charge the surface of the electrophotographic photoreceptor; an exposing unit to perform exposure of the electrophotographic photoreceptor charged by the charging unit; a developing unit to feed a toner having an externally added lubricant to the electrophotographic photoreceptor exposed by the exposing unit to form a toner image; a transfer unit to transfer the toner image onto the electrophotographic photoreceptor; and a cleaning unit to remove the residual toner on the surface of the electrophotographic photoreceptor, wherein the electrophotographic photoreceptor includes a conductive support, a photoreceptive layer, and a protective layer disposed in sequence, the protective layer includes a resin containing a particulate P-type semiconductor, and the protective layer has a surface roughness Rz of 0.030 μm or more and 0.075 μm or less.

Preferably, wherein the resin forming the protective layer is a curable resin prepared through a polymerization reaction of a crosslinkable polymerizable compound, and the protective layer has a universal hardness of 200 $N/mm^2$ or more and 320 $N/mm^2$ or less.

Preferably, the particulate P-type semiconductor consists of $CuAlO_2$.

Preferably, the lubricant includes zinc stearate.

Preferably, the lubricant feeding unit includes a solid lubricant and a lubricant applying member.

A process of forming an image according to the present invention includes the steps of charging the surface of an electrophotographic photoreceptor; performing exposure of the charged electrophotographic photoreceptor; feeding a toner to the exposed electrophotographic photoreceptor to form a toner image; transferring the toner image formed on the electrophotographic photoreceptor; feeding a lubricant onto the surface of the electrophotographic photoreceptor; and removing the residual toner on the surface of the electrophotographic photoreceptor, wherein the electrophotographic photoreceptor includes a conductive support, a photoreceptive layer, and a protective layer disposed in sequence, the protective layer includes a resin containing a particulate P-type semiconductor, and the protective layer has a surface roughness Rz of 0.030 μm or more and 0.075 μm or less.

The process of forming an image according to the present invention can include the step of feeding a lubricant in the form of a particulate lubricant externally added to a toner to the photoreceptor by the action of the development field formed during the developing step.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein.

DETAILED DESCRIPTION OF THE PREFERRED EMBODIMENT

The present invention will now be described in detail.

[Photoreceptor]

In the present invention, an organic photoreceptor is mountable on an imaging apparatus including a charging unit, an exposing unit, a developing unit, a transfer unit, a cleaning unit, and a lubricant feeding unit for feeding a lubricant onto the surface of the photoreceptor. This organic photoreceptor includes a conductive support, a photoreceptive layer, and a protective layer sequentially disposed.

Throughout the specification, the organic photoreceptor indicates a photoreceptor composed of an organic compound having at least one of the charge generating function and the charge transporting function essential for the photoreceptor. The organic photoreceptor includes all of known organic photoreceptors, such as those including organic photoreceptive layers composed of known organic charge generating materials or organic charge transport materials and those including organic photoreceptive layers composed of polymer complexes having charge generating functions and those having charge transporting functions.

Figure 1:
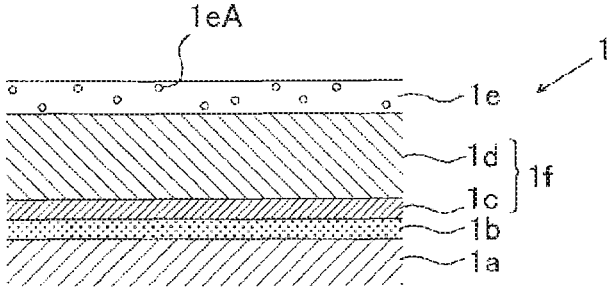
FIG. 1 is a partial cross-sectional view illustrating a layer configuration of the electrophotographic photoreceptor according to the present invention.

For example, as illustrated in FIG. 1, a photoreceptor 1 includes a conductive support 1*a*, an intermediate layer 1*b*, a charge generating layer 1*c*, a charge transporting layer 1*d*, and a protective layer 1*e* sequentially laminated. The charge generating layer 1*c* and the charge transporting layer 1*d* form a photoreceptive layer 1*f*. The protective layer 1*e* contains a particulate P-type semiconductor 1*e*A.

[Protective Layer 1*e*]

The protective layer included in the photoreceptor according to the present invention is composed of a binder resin (hereinafter, also referred to as "binder resin for a protective layer") and a particulate P-type semiconductor 1*e*A. The protective layer has a surface roughness Rz of 0.030 μm or more and 0.075 μm or less.

Such a photoreceptor including a protective layer containing the particulate P-type semiconductor and having a surface roughness Rz in a specific low range results in long-term stable cleaning characteristics that contribute to formation of highly stable quality of images.

The present inventors infer that the photoreceptor including such a protective layer can stably have high cleaning characteristics because a small amount of lubricant can be highly uniformly applied due to electrostatic behaviors of the particulate P-type semiconductor.

The surface roughness Rz indicates the maximum height roughness Rz, which is the sum of the maximum height and the maximum depth in the roughness curve obtained through measurement along the reference length (λc), in accordance with JIS B0601(2001). Specifically, the surface roughness Rz is defined as the sum (Rz=Rp+Rv) of the maximum value Rp of the height Zp and the maximum value Rv of the depth Zv in the outline curve of the reference length.

The surface roughness Rz of the photoreceptor according to the present invention is defined as the average of 100 maximum heights roughness measured with a surface roughness analyzer "SURFCOM 1400D" (made by TOKYO SEIMITSU CO., LTD.) at a reference length λc of 0.08 mm, a length L for evaluation of 8 mm, and a scanning rate of 0.15 mm/sec.

The surface roughness Rz can be controlled through adjustment of the solid content in a coating solution for forming a protective layer or the temperature. The surface roughness Rz can also be controlled through adjustment of the drying rate of the coating formed of the coating solution for forming a protective layer. Specifically, the surface roughness Rz can be decreased, for example, by increasing the drying rate with a circular forced exhaust apparatus to promote evaporation of the solvent. The surface roughness Rz can be increased by reducing the drying rate with a drying hood to reduce the evaporation rate of the solvent.

A surface roughness Rz of the photoreceptor of less than 0.030 μm decreases the amount of the lubricant to be applied onto the surface of the photoreceptor. As a result, the lubricant cannot be uniformly applied onto the surface of the photoreceptor, leading to generation of forward-directional (FD) striations extending in the traveling direction of a transfer material. A surface roughness Rz of the photoreceptor of more than 0.075 μm significantly increases the amount of the lubricant to be applied onto the surface of the photoreceptor, leading to generation of fogging or blurring in the images to be formed.

[Particulate P-Type Semiconductor 1*e*A]

The particulate P-type semiconductor has holes as charge-transporting carriers, and contributes to stability of the image quality.

The particulate P-type semiconductors preferably used in the present invention are metal oxide nanoparticles. Particularly preferred is a compound represented by Formula (1) or Formula (2). $Cu_2O$ may also be used as the particulate P-type semiconductor.

$$CuM^1O_2 \qquad \text{Formula (1):}$$

where $M^1$ represents an element of Group XIII in the periodic table;

$$M^2Cu_2O_2 \qquad \text{Formula (2):}$$

where $M^2$ represents an element of Group II in the periodic table.

Specific examples of the element of Group XIII in the periodic table include boron (B), aluminum (Al), gallium (Ga), indium (In), and thallium (Tl). Preferred are aluminum, gallium, and indium in the present invention.

Preferred examples of the compound represented by Formula (1) in the present invention include $CuAlO_2$, $CuGaO_2$, and $CuInO_2$.

Specific examples of the Group II elements in the periodic table include beryllium (Be), magnesium (Mg), calcium (Ca), strontium (Sr), barium (Ba), and radium (Ra). Preferred are barium and strontium in the present invention.

Preferred examples of the compound represented by Formula (2) in the present invention include $BaCu_2O_2$ and $SrCu_2O_2$.

The particulate P-type semiconductor has a number average primary particle size of preferably 1 to 300 nm, more preferably 3 to 100 nm.

Such a particulate P-type semiconductor having a number average primary particle size within this range results in a protective layer having appropriate charge transportability and a photoreceptor having a surface roughness Rz controlled within the specific range.

The number average primary particle size of the particulate P-type semiconductor is determined as follows: A sample of the particulate P-type semiconductor is photographed with a scanning electron microscope "JSM-7500F" (made by JEOL, Ltd.) at a magnification of ×100000, and the photograph is input with a scanner. The input photographic image of the sample is binarized with an automatic image processing analyzer "LUZEX AP (software Ver. 1.32)" (made by NIRECO CORPORATION), and the horizontal Feret diameters of 100 nanoparticles selected at random in the binarized image (excluding aggregated particles) are calculated. The average value is defined as the number average primary particle size. Throughout the specification, the horizontal Feret diameter indicates the length of a side parallel to the x-axis among the sides of a rectangle circumscribing a nanoparticle in the binarized image of the particulate P-type semiconductor.

The particulate P-type semiconductor can be prepared by sintering, for example. Specifically, in preparation of a $CuAlO_2$ particulate P-type semiconductor, $Al_2O_3$ (purity: 99.9%) and $Cu_2O$ (99.9%) are mixed at a molar ratio of 1:1, and are calcined in an Ar atmosphere at 1100° C. for four days. The product is molded into pellets, which are sintered at 1100° C. for two days to prepare a sintered product. In the next step, the sintered product is ground into coarse particles of several hundreds of micrometers. The coarse particles are pulverized with a solvent in a wet pulverizer of a medium dispersion type to prepare nanoparticles of $CuAlO_2$ having a desired particle size.

The particulate P-type semiconductor can also be prepared by a plasma process, for example. Examples of the plasma process include DC plasma arc, high-frequency plasma, and plasma jet processes.

In the DC plasma arc processes, a particulate P-type semiconductor can be prepared as follows: A metal alloy is used as a consumptive anode electrode, and is evaporated by heat of the plasma flame generated from a cathode electrode. The vapor of the metal alloy is oxidized, and is cooled.

In the high frequency plasma processes, a particulate P-type semiconductor can be prepared using a thermal plasma generated through heating of a gas under atmospheric pressure by high-frequency inductive discharge. In a plasma evaporation process among these high-frequency plasma processes, solid particles are injected into the center of an inert gas plasma, and are evaporated in the plasma. This vapor at a high temperature is condensed by quenching to prepare a particulate P-type semiconductor.

In the plasma processes, arc discharge is performed in an atmosphere of an inert argon gas or a gas of a diatomic molecule hydrogen, nitrogen, or oxygen to generate argon plasma or hydrogen, nitrogen, or oxygen plasma. The hydrogen, nitrogen, and oxygen plasmas differ from the inert gas plasma in their significantly high reactivities, and are referred to as reactive arc plasmas.

Among these reactive arc plasmas, the oxygen plasma can be suitably used in preparation of the particulate P-type semiconductor by the plasma process.

The content of the particulate P-type semiconductor is preferably 20 to 300 parts by mass, more preferably 50 to 200 parts by mass in 100 parts by mass of the binder resin for a protective layer.

At a content of the particulate P-type semiconductor within this range, appropriate charge transportability of the protective layer can be attained, and the surface roughness Rz of the photoreceptor can be controlled within the specific range. Furthermore, the hardness of the protective layer can be appropriately controlled.

[Surface Treated Particulate P-Type Semiconductor]

The particulate P-type semiconductor contained in the protective layer is preferably surface-treated with a surface treating agent, more preferably surface-treated with a surface treating agent having a reactive organic group to have high dispersibility and enhance wear resistance of the protective layer.

The surface treating agents preferably used are those reactive with hydroxy groups present in the surface of the untreated particulate P-type semiconductor. Examples of such surface treating agents include silane coupling agents and titanium coupling agents.

Preferred in the present invention are surface treating agents having reactive organic groups to further increase the hardness of the protective layer. More preferred are those having radically polymerizable reactive organic groups. In binder resins for a protective layer containing curable resins composed of the following polymerizable compounds, such a surface treating agent having a radically polymerizable reactive organic group can also react with the polymerizable compounds to form firm protective layers.

Preferred surface treating agents having radically polymerizable reactive organic groups are silane coupling agents having acryloyl or methacryloyl groups. Examples of the surface treating agent having a radically polymerizable reactive organic group include the following known compounds.

Examples of the silane coupling agent having an acryloyl or methacryloyl group include the following compounds:

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)\ Si(OCH_3)_3$
S-22: $CH_2{=}C(CH_3)\ Si(OC_2H_5)_3$
S-23: $CH_2{=}CHSi(OCH_3)_3$
S-24: $CH_2{=}C(CH_3)\ Si(CH_3)(OCH_3)_2$
S-25: $CH_2{=}CHSi(CH_3)\ Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2\ (OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})\ (OCH_3)_2$
S-36: $CH_2{=}CHCOO(CH_2)_2Si(CH_2C_6H_5)(OCH_3)_2$

Besides compounds S-1 to S-36, silane compounds having reactive organic groups to enable a radical polymerization reaction can also be used as the surface treating agent. These surface treating agents can be used alone or in combination.

The surface treating agent can be used in any amount, and is preferably used in an amount of 0.1 to 100 parts by mass relative to 100 parts by mass of the untreated particulate P-type semiconductor.

[Surface Treatment Process of Particulate P-Type Semiconductor]

The particulate P-type semiconductor can be surface-treated as follows: A slurry containing an untreated particulate P-type semiconductor and a surface treating agent (suspension of solid particles) is wet milled to pulverize the particulate P-type semiconductor and simultaneously modify the surface of the particulate P-type semiconductor. The solvent is then removed to recover powder.

A preferred slurry is composed of 0.1 to 100 parts by mass of surface treating agent and 50 to 5000 parts by mass of solvent mixed with 100 parts by mass of untreated particulate P-type semiconductor.

Examples of the apparatus used for wet pulverization of the slurry include wet medium dispersers.

A typical wet disperser operates as follows: A container of the wet medium disperser is filled with beads as dispersion media, and a stirring disk attached vertical to the rotary shaft is rotated at a high speed to pulverize and disperse aggregates of the particulate P-type semiconductor. The wet medium disperser can have any configuration which enables sufficient dispersion of the particulate P-type semiconductor and the surface treatment of the particulate P-type semiconductor at the same time during the surface treatment of the particulate P-type semiconductor. For example, usable wet medium dispersers can be of a variety of types, such as vertical, horizontal, continuous, and batch types. Specific examples of the usable wet disperser include sand mills, Ultra Visco Mills, pearl mills, grain mills, DYNO-MILL, agitator mills, and dynamic mills. These dispersers pulverize and disperse particles by impact pressure, friction, shear, and shear stress of grinding media, such as balls and beads.

Examples of beads used in the wet medium disperser include balls composed of glass, alumina, zircon, zirconia, steel, and flint. Particularly preferred are zirconia and zircon beads. Although beads having a diameter of about 1 to 2 mm are usually used, those having a diameter of about 0.1 to 1.0 mm are preferably used in the present invention.

Although the wet medium disperser can include the disk and the inner wall of the container composed of a variety of materials, such as stainless steel, nylon, and ceramics, particularly preferred materials for the disk and the inner wall of the container in the present invention are ceramics, such as zirconia or silicon carbide.

[Binder Resin for Protective Layer]

The binder resin for a protective layer is preferably a thermoplastic resin or a photocurable resin. A photocurable resin is particularly preferable to attain high film strength.

Examples of usable binder resins for a protective layer include poly(vinyl butyral) resins, epoxy resins, polyurethane resins, phenol resins, polyester resins, alkyd resins, polycarbonate resins, silicone resins, acrylic resins, and melamine resins. Among thermoplastic resins, preferred are polycarbonate resins. Among photocurable resins, preferred are curable resins prepared through polymerization reaction of crosslinkable polymerizable compounds, specifically compounds having two or more radically polymerizable functional groups (hereinafter, also referred to as "radically polymerizable polyfunctional compound") irradiated with active rays, such as ultraviolet light or electron beams.

These binder resins for a protective layer listed above can be used alone or in combination.

[Radically Polymerizable Polyfunctional Compound]

Among radically polymerizable polyfunctional compounds, particularly preferred are acrylic monomers or oligomers thereof having two or more acryloyl groups ($CH_2{=}CHCO{-}$) or two or more methacryloyl groups ($CH_2{=}CCH_3CO{-}$) as radically polymerizable functional groups because these are curable with a small amount of light or in a short time. Accordingly, preferred curable resins are acrylic resins composed of acrylic monomers or oligomers thereof.

Examples of these radically polymerizable polyfunctional compounds include the following compounds:

[Formula 1]

M1

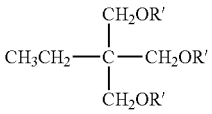

M2

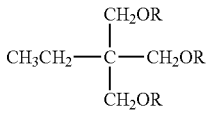

M3

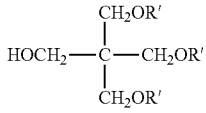

M4

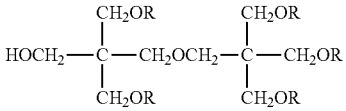

M5

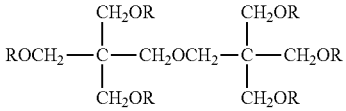

M6

M7

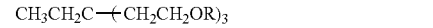

[Formula 2]

M8

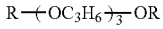

M9

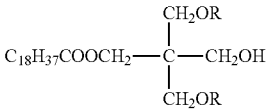

M10

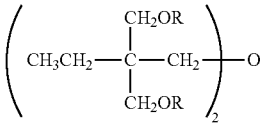

M11

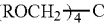

M12

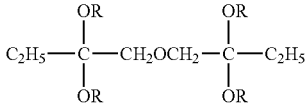

-continued

M13

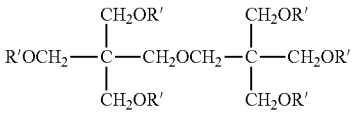

M14

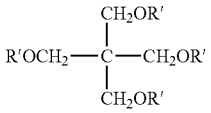

M15

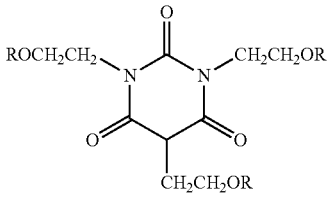

where R represents an acryloyl group ($CH_2{=}CHCO{-}$), and R' represents a methacryloyl group ($CH_2{=}CCH_3CO{-}$).

Besides the binder resin for a protective layer and the particulate P-type semiconductor described above, the protective layer may contain a particulate lubricant and a variety of antioxidants, as needed, in amounts such that the surface roughness Rz of the photoreceptor is kept within the range specified above.

[Particulate Lubricant]

Examples of the particulate lubricant include particulate fluorine atom-containing resins. Examples of the particulate fluorine atom-containing resins include particulate tetrafluoroethylene, trifluorochloroethylene, hexafluorochloroethylene-propylene, vinyl fluoride, vinylidene fluoride, and difluorodichloroethylene resins. These polymers can be used alone or in combination. Among these resins, particularly preferred are tetrafluoroethylene and vinylidene fluoride resins.

The protective layer preferably has a universal hardness of 200 $N/mm^2$ or more and 320 $N/mm^2$ or less.

A protective layer having a universal hardness of 200 $N/mm^2$ or more results in a photoreceptor having high resistance to wear and thus high retentiveness of the lubricant. As a result, high cleaning characteristics of the photoreceptor are attained. A protective layer having a universal hardness of 320 $N/mm^2$ or less can appropriately circulate the lubricant to prevent accumulation of an excess lubricant on the surface of the photoreceptor, and thus can prevent fogging and blurring of images.

The universal hardness of the protective layer in the present invention is determined with a microhardness testing system "FISCHERSCOPE H100" (made by Fischer Instruments K.K.).

Specifically, in "FISCHERSCOPE H100", a load F is applied to a Vickers indenter composed of quadrangular pyramidal diamond to press the surface of the photoreceptor, and the resulting depth is defined as a depth h. The universal hardness is determined from the depth h, the load F by the following expression (HU):

HU (universal hardness)$=F/(26.45\times h^2)$

The universal hardness of the protective layer can be controlled by curing conditions on formation of the protective layer (irradiation time of active rays and the type of active rays) or the type of the polymerizable compounds.

The protective layer has a thickness of preferably 0.2 to 10 μm, more preferably 0.5 to 6 μm.

[Formation of Protective Layer]

The protective layer can be formed as follows: A radically polymerizable polyfunctional compound, a particulate P-type semiconductor, and optional components, such as a known resin, a polymerization initiator, a particulate lubricant, and an antioxidant, are added to a solvent to prepare a coating solution. The coating solution is applied onto the surface of the charge transporting layer by a known method to forma coating, and the coating is cured.

[Polymerization Initiator]

The protective layer can contain a radical polymerization initiator which can initiate the polymerization reaction of the radically polymerizable polyfunctional compound. Examples of such a radical polymerization initiator include thermal polymerization initiators and photopolymerization initiators. The polymerization reaction of the radically polymerizable polyfunctional compound can be performed by processes using an electron beam cleavage reaction or using light or heat in the presence of a radical polymerization initiator.

Examples of the thermal polymerization initiators include azo compounds, such as 2,2'-azobisisobutyronitrile, 2,2'-azobis(2,4-dimethylazobisvaleronitrile), and 2,2'-azobis(2-methylbutyronitrile); and peroxides, such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, and lauroyl peroxide.

Examples of the photopolymerization initiators include acetophenone or ketal photopolymerization initiators, such as diethoxyacetophenone, 2,2-dimethoxy-1,2-diphenylethan-1-one, 1-hydroxycyclohexyl phenyl ketone, 4-(2-hydroxyethoxy)phenyl(2-hydroxy-2-propyl) ketone, 2-benzyl-2-dimethylamino-1-(4-morpholinophenyl)butanone-1 ("IRGACURE 369" (made by BASF SE)), 2-hydroxy-2-methyl-1-phenylpropan-1-one, 2-methyl-2-morpholino(4-methylthiophenyl)propan-1-one, and 1-phenyl-1,2-propanedione-2-(o-ethoxycarbonyl)oxime; benzoin ether photopolymerization initiators, such as benzoin, benzoin methyl ether, benzoin ethyl ether, benzoin isobutyl ether, and benzoin isopropyl ether; benzophenone photopolymerization initiators, such as benzophenone, 4-hydroxybenzophenone, methyl o-benzoylbenzate, 2-benzoylnaphthalene, 4-benzoylbiphenyl, 4-benzoyl phenyl ether, acrylic benzophenone, and 1,4-benzoylbenzene; and thioxanthone photopolymerization initiators, such as 2-isopropylthioxanthone, 2-chlorothioxanthone, 2,4-dimethylthioxanthone, 2,4-diethylthioxanthone, and 2,4-dichlorothioxanthone.

Other examples of the photopolymerization initiator include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide ("IRGACURE 819" (made by BASF SE)), bis(2,4-dimethoxybenzoyl)-2,4,4-trimethylpentylphosphine oxide, methylphenylglyoxy ester, 9,10-phenanthrene, acridine compounds, triazine compounds, and imidazole compounds. A photopolymerization initiator having an effect of promoting photopolymerization can be used alone or in combination with the photopolymerization initiator listed above. Examples of such a photopolymerization initiator having an effect of promoting photopolymerization include triethanolamine, methyldiethanolamine, ethyl 4-(dimethylamino)benzoate, isoamyl 4-(dimethylamino)benzoate, ethyl (2-dimethylamino)benzoate, and 4,4'-dimethylaminobenzophenone.

Preferred polymerization initiators are photopolymerization initiators. More preferred are alkylphenone compounds and phosphine oxide compounds. Still more preferred are photopolymerization initiators having an α-hydroxyacetophenone structure or an acylphosphine oxide structure.

These polymerization initiators may be used alone or in combination.

The polymerization initiator is used in an amount of 0.1 to 40 parts by mass, preferably 0.5 to 20 parts by mass relative to 100 parts by mass of the radically polymerizable polyfunctional compound.

[Solvent]

Examples of the solvent used in formation of the protective layer include, but should not be limited to, methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, methylene chloride, ethyl acetate, butyl acetate, 2-methoxyethanol, 2-ethoxyethanol, tetrahydrofuran, 1-dioxane, 1,3-dioxolane, pyridine, and diethylamine.

These solvents can be used alone or in combination.

In a preferred curing treatment, the coating is irradiated with active rays to generate radicals for polymerization, and inter- and intramolecular crosslinking bonds are formed by a crosslinking reaction to form a protective layer. Active rays preferably used are light, such as ultraviolet light and visible light, and electron beams. Particularly preferred is ultraviolet light, which is easy to use.

Examples of light sources of ultraviolet light include low pressure mercury lamps, middle pressure mercury lamps, high pressure mercury lamps, ultra-high pressure mercury lamps, carbon arc lamps, metal halide lamp, xenon lamps, flash (pulse) xenon lamps, and ultraviolet light LEDs. Although the irradiation conditions are varied according to the type of lamps, the amount of active rays to be irradiated is usually 1 to 20 mJ/cm$^2$, preferably 5 to 15 mJ/cm$^2$. The light source has an output voltage of preferably 0.1 to 5 kW, particularly preferably 0.5 to 3 kW.

Electron beam sources preferably used are curtain beam-type electron beam irradiators. The accelerating voltage of the electron beams during irradiation is preferably 100 to 300 kV. The absorption dose is preferably 0.005 Gy to 100 kGy (0.5 to 10 Mrad).

The irradiation time for active rays can be any time such that the necessary irradiation amount of active rays can be obtained. Specifically, the irradiation time is preferably 0.1 seconds to 10 minutes, more preferably 1 second to 5 minutes in view of curing efficiency or working efficiency.

The coating may be dried before, after, or during irradiation of active rays. The timing for drying can be appropriately selected according to the combination of active rays and the irradiation conditions. The conditions for drying of the protective layer can be appropriately selected according to the type of the solvent used as the coating solution and the thickness of the protective layer. The drying temperature is preferably room temperature to 180° C., particularly preferably 80 to 140° C. The drying time is preferably 1 to 200 minutes, particularly preferably 5 to 100 minutes. Drying of the coating on such conditions can control the amount of the solvent contained in the protective layer within the range of 20 ppm to 75 ppm.

The layer configuration other than the protective layer in the photoreceptor will now be described.

[Conductive Support 1*a*]

The conductive support may be composed of any material. Examples of the material include metals, such as aluminum, copper, chromium, nickel, zinc, and stainless steel, in the form of a drum or a sheet; laminates of plastic films and metal foils of aluminum or copper; plastic films on which aluminum, indium oxide, or tin oxide is deposited; and metals, plastic films, and papers having conductive layers disposed thereon through application of a single conductive substance or a combination thereof with a binder resin.

[Intermediate Layer 1*b*]

The intermediate layer functions as a barrier between the conductive support and the organic photoreceptive layer, and bonds these layers. Such an intermediate layer is preferably disposed to prevent a variety of failures.

Such an intermediate layer is composed of a binder resin (hereinafter, also referred to as "binder resin for an intermediate layer"), and optional conductive particles or metal oxide particles, for example.

Examples of the binder resin for an intermediate layer include casein, poly(vinyl alcohol), nitrocellulose, ethylene-acrylic copolymers, polyamide resins, polyurethane resins, and gelatin. Among these resins, preferred are alcohol-soluble polyamide resins.

The intermediate layer can contain a variety of conductive particles or metal oxide particles to have suitable resistance. A variety of metal oxide particles, such as alumina, zinc oxide, titanium oxide, tin oxide, antimony oxide, indium oxide, and bismuth oxide particles can be used. Ultrananoparticles of tin-doped indium oxide and antimony-doped tin oxide and zirconium oxide can also be used.

These metal oxide particles have a number average primary particle size of preferably 0.3 μm or less, more preferably 0.1 μm or less.

These metal oxide particles may be used alone or in combination. A combination of these metal oxide particles may be in the form of a solid solution or a fused product.

The content of the conductive particles or the metal oxide particles is preferably 20 to 400 parts by mass, more preferably 50 to 200 parts by mass relative to 100 parts by mass of the binder resin for an intermediate layer.

The intermediate layer can be formed as follows: For example, the binder resin for an intermediate layer is dissolved in a known solvent, and when necessary, conductive particles or metal oxide particles are dispersed to prepare a coating solution for forming an intermediate layer. The coating solution for forming an intermediate layer is applied onto the surface of the conductive support to form a coating, and the coating is dried.

Any solvent can be used in formation of the intermediate layer. Examples of usable solvents include n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethyl sulfoxide, and methyl cellosolve. Among these solvents, preferred are toluene, tetrahydrofuran, and dioxolane. These solvents can be used alone, or a mixed solvent thereof can be used.

The conductive particles or the metal oxide particles can be dispersed with an ultrasonic disperser, a ball mill, a sand grinder, or a homomixer.

The coating solution for forming an intermediate layer can be applied by any process, such as immersion application and spray coating.

The coating can be dried by a known drying method appropriately selected according to the type of the solvent or the thickness of the intermediate layer to be formed. Particularly preferred is heat drying.

The intermediate layer has a thickness of preferably 0.1 to 15 μm, more preferably 0.3 to 10 μm.

[Charge Generating Layer 1*c]*

The charge generating layer is composed of a charge generating material and a binder resin (hereinafter, also referred to as "binder resin for a charge generating layer").

Examples of the charge generating material include, but should not be limited to, azo pigments, such as Sudan red and Dian blue; quinone pigments, such as pyrenequinone and anthanthrone; quinocyanine pigments; perylene pigments; indigo pigments, such as indigo and thioindigo; polycyclic quinone pigments, such as pyranthrone and diphthaloylpyrene; and phthalocyanine pigments. Among these charge generating materials, preferred are polycyclic quinone pigments and titanyl phthalocyanine pigments.

These charge generating materials may be used alone or in combination.

Any known resin can be used as the binder resin for a charge generating layer. Examples of such a resin include, but should be limited to, polystyrene, polyethylene, polypropylene, acrylic, methacrylic, poly(vinyl chloride), poly (vinyl acetate), poly(vinyl butyral), epoxy, polyurethane, phenol, polyester, alkyd, polycarbonate, silicone, and melamine resins, copolymer resins containing two or more of these resins (such as vinyl chloride-vinyl acetate copolymer resins and vinyl chloride-vinyl acetate-maleic anhydride copolymer resins), and poly(vinyl carbazole) resins. Among these resins, preferred are poly(vinyl butyral) resins.

The content of the charge generating material in the charge generating layer is preferably 1 to 600 parts by mass, more preferably 50 to 500 parts by mass relative to 100 parts by mass of the binder resin for a charge generating layer.

The content of the charge generating material mixed with the binder resin for a charge generating layer is preferably 20 to 600 parts by mass, more preferably 50 to 500 parts by mass relative to 100 parts by mass of the binder resin for a charge generating layer. The charge generating material mixed with the binder resin for a charge generating layer in a proportion within this range results in high dispersion stability in a coating solution for forming a charge generating layer described later, and thus a photoreceptor having low electric resistance to minimize an increase in residual potential accompanying repeated use.

The charge generating layer can be formed as follows: For example, the charge generating material is added to a binder resin for a charge generating layer dissolved in a known solvent, and is dispersed to prepare a coating solution for forming a charge generating layer. The coating solution for forming a charge generating layer is applied onto the surface of the intermediate layer, and the coating is dried.

The charge generating layer can be formed with any solvent which can dissolve the binder resin for a charge generating layer. Examples of such a solvent include ketone solvents, such as methyl ethyl ketone, methyl isopropyl ketone, methyl isobutyl ketone, cyclohexanone, and acetophenone; ether solvents, such as tetrahydrofuran, dioxolane, and diglyme; alcohol solvents, such as methyl cellosolve, ethyl cellosolve, and butanol; ester solvents thereof, such as ethyl acetate and t-butyl acetate; aromatic solvents, such as toluene and chlorobenzene; and halogen solvents, such as dichloroethane and trichloroethane. These solvents can be used alone or in combination.

The method of dispersing the charge generating material is the same as the method of dispersing the conductive particles or the metal oxide particles in the coating solution for forming an intermediate layer.

The process of applying the coating solution for forming a charge generating layer is the same as the process of application of the coating solution for forming an intermediate layer.

Although the thickness of the charge generating layer is varied depending on the characteristics of the charge generating material, those of the binder resin for a charge generating layer, and the contents thereof, the thickness is preferably 0.1 to 2 μm, more preferably 0.15 to 1.5 μm.

[Charge Transporting Layer 1*d]*

The charge transporting layer is composed of a charge transport material and a binder resin (hereinafter, also referred to as "binder resin for a charge transporting layer").

Examples of the charge transport material contained in the charge transporting layer include triphenylamine derivatives, hydrazone compounds, styryl compounds, benzidine compounds, and butadiene compounds.

A known resin can be used as the binder resin for a charge transporting layer. Examples of such a known resin include polycarbonate resins, polyacrylate resins, polyester resins, polystyrene resins, styrene-acrylonitrile copolymer resins, polymethacrylate resins, and styrene-methacrylate copolymer resins. Preferred are polycarbonate resins. Also preferred are polycarbonate resins of a bisphenol A (BPA) type, a bisphenol Z (BPZ) type, a dimethyl BPA type, and a BPA-dimethyl BPA copolymer type in view of crack resistance, wear resistance, and charging characteristics.

The content of the charge transport material in the charge transporting layer is preferably 10 to 500 parts by mass, more preferably 20 to 250 parts by mass relative to 100 parts by mass of the binder resin for a charge transporting layer.

The charge transporting layer may contain an antioxidant, an electron conductive agent, a stabilizer, and silicone oil. Preferred antioxidants are those disclosed in Japanese Patent Application Laid-Open No. 2000-305291, and preferred electron conductive agents are those disclosed in Japanese Patent Application Laid-Open Nos. 50-137543, and 58-76483.

Although the thickness of the charge transporting layer is varied according to the characteristics of the charge transport material, those of the binder resin for a charge transporting layer, and the contents thereof, the thickness is preferably 5 to 40 μm, more preferably 10 to 30 μm.

The charge transporting layer can be formed as follows: For example, the charge transport material (CTM) is added to the binder resin for a charge transporting layer dissolved in a known solvent, and is dispersed to prepare a coating solution for forming a charge transporting layer. The coating solution for forming a charge transporting layer is applied onto the surface of the charge generating layer to form a coating, and the coating is dried.

Examples of the solvent used in formation of the charge transporting layer include the same solvents as those used in formation of the charge generating layer.

Examples of the process of applying the coating solution for forming a charge transporting layer include the same processes as in application of the coating solution for forming a charge generating layer.

The photoreceptor having the configuration described above can have highly stable cleaning characteristics, and thus high stability of the quality of images to be formed for a long time because the photoreceptor includes the protective layer containing the particulate P-type semiconductor and having a surface roughness Rz of 0.030 μm or more and 0.075 μm or less.

[Imaging Apparatus]

The imaging apparatus according to the present invention includes a photoreceptor, a charging unit to charge the surface of the photoreceptor, an exposing unit to perform exposure of the photoreceptor charged by the charging unit to form an electrostatic latent image, a developing unit to feed a toner to the photoreceptor and develop the electrostatic latent image with the toner to forma toner image, a transfer unit to transfer the toner image formed on the photoreceptor, a lubricant feeding unit to feed a lubricant onto the surface of the photoreceptor, and a cleaning unit to remove a residual toner on the surface of the photoreceptor. The imaging apparatus according to the present invention includes the above-described photoreceptor according to the present invention as the photoreceptor.

Figure 2:
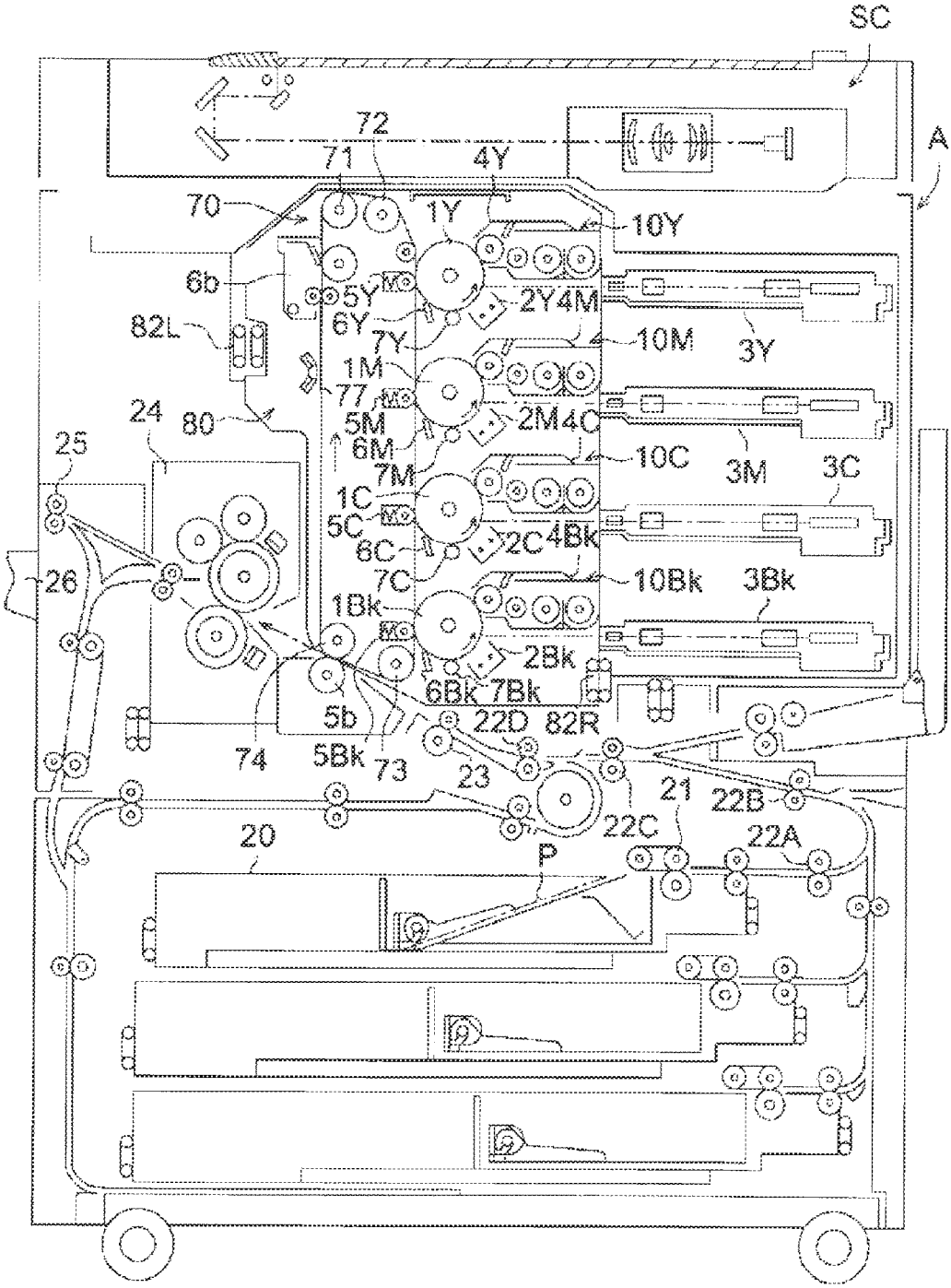
FIG. 2 is a cross-sectional view illustrating a configuration of an exemplary imaging apparatus according to the present invention.
Figure 3:
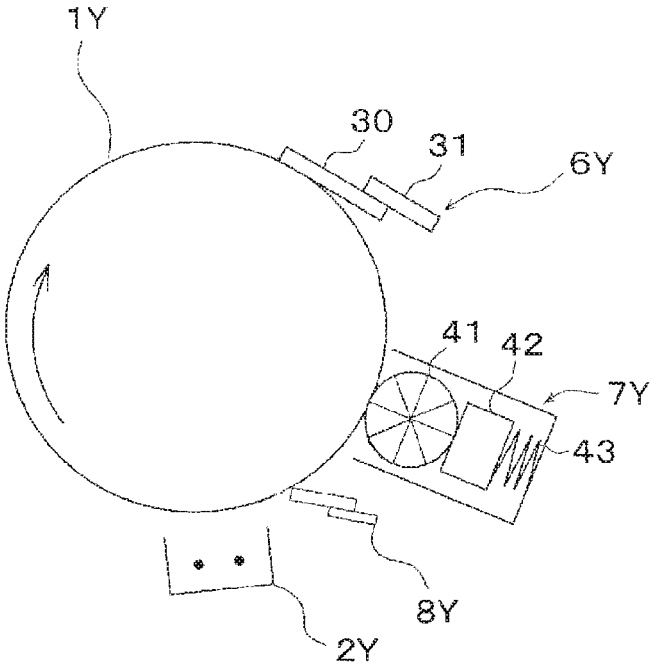
FIG. 3 is a cross-sectional view illustrating an example of a configuration of the main components included in the imaging apparatus according to the present invention.

FIG. 2 is a cross-sectional view illustrating a configuration of an exemplary imaging apparatus according to the present invention. FIG. 3 is a cross-sectional view illustrating an example of a configuration of the main components included in the imaging apparatus according to the present invention.

This imaging apparatus is referred to as a tandem color imaging apparatus including four imaging units (image forming units) 10Y, 10M, 10C, and 10Bk, an intermediate transfer unit 70, a feeding unit 21, and a fixing unit 24. The imaging apparatus has a scanner SC for reading an original image disposed in an upper portion of the body A.

The four image forming units 10Y, 10M, 10C, and 10Bk, respectively, include photoreceptors 1Y, 1M, 1C, and 1Bk, charging units 2Y, 2M, 2C, and 2Bk, exposing units 3Y, 3M, 3C, and 3Bk, rotary developing units 4Y, 4M, 4C, and 4Bk, primary transfer rollers 5Y, 5M, 5C, and 5Bk as the primary transfer unit, lubricant feeding units 7Y, 7M, 7C, and 7Bk, and cleaning units 6Y, 6M, 6C, and 6Bk configured to clean the photoreceptors 1Y, 1M, 1C, and 1Bk.

The imaging apparatus according to the present invention includes the above-described photoreceptor according to the present invention as the photoreceptors 1Y, 1M, 1C, and 1Bk.

The image forming units 10Y, 10M, 10C, and 10Bk have the same configuration except that the toner images formed on the photoreceptors 1Y, 1M, 1C, and 1Bk have different colors, yellow, magenta, cyan, and black. Accordingly, the image forming unit 10Y will be described in detail by way of an example.

The image forming unit 10Y includes the photoreceptor 1Y (image forming member) and the charging unit 2Y, the exposing unit 3Y, the developing unit 4Y, and the cleaning unit 6Y disposed adjacent to the photoreceptor to form a toner image of yellow (Y) on the photoreceptor 1Y.

The charging unit 2Y is configured to uniformly charge the surface of the photoreceptor 1Y to the negative polarity. The charging unit 2Y is a corona discharger, for example.

The exposing unit 3Y is configured to perform exposure of the photoreceptor 1Y having the uniform potential charged by the charging unit 2Y according to the (yellow) image signals to form an electrostatic latent image corresponding to an image of yellow. The exposing unit 3Y is composed of an array of LEDs disposed along the axis of the photoreceptor 1Y and imaging elements, or a laser optical system.

The developing unit 4Y is composed of a rotary developing sleeve having a built-in magnet to retain a developer, and a voltage applying device which applies DC and/or AC bias voltage between the photoreceptor and the developing sleeve, for example.

[Lubricant Feeding Unit]

The lubricant feeding unit 7Y is configured to feed a lubricant onto the surface of the photoreceptor 1Y. A coating of the lubricant is formed on the surface of the photoreceptor 1Y by the lubricant feeding unit 7Y.

The lubricant feeding unit 7Y is disposed at a position after the cleaning unit 6Y and before the charging unit 2Y in the rotational direction of the photoreceptor 1Y in the imaging apparatus in FIG. 2.

The lubricant feeding unit 7Y can be disposed at any other position than the position after the cleaning unit 6Y and before the charging unit 2Y.

An exemplary lubricant feeding unit 7Y is composed of a solid lubricant and a lubricant applicator or a brush roller. In detail, the lubricant feeding unit 7Y includes a lubricant stock 42 composed of a rectangular solid lubricant, a brush roller 41 disposed in contact with the surface of the photoreceptor 1Y to scrape the lubricant by sliding the surface of the lubricant stock 42 and apply the lubricant onto the surface of the photoreceptor 1Y, a pressurized spring 43 which presses the lubricant stock 42 against the brush roller 41, and a driving mechanism (not illustrated) configured to drive the brush roller 41. The tip of the brush roller 41 is in contact with the surface of the photoreceptor 1Y. The brush roller 41 is driven at the same speed in the same rotational direction as those of the photoreceptor 1Y.

The brush roller 41 can be formed, for example, as follows: A pile-woven cloth composed of a base cloth and fiber bundles as pile yarns woven into the base cloth is formed into a ribbon. The ribbon is spirally wound around a metal shaft with the piled surface of the ribbon facing upwards, and is bonded to the metal shaft. The exemplified brush roller 41 is composed of a roller base and a long woven fabric planted with a high density of brush hairs made of a resin, such as polypropylene, and disposed on the circumferential surface of the roller base.

Preferred are straight brush hairs raised vertical to the metal shaft in view of applicability. The yarn for brush hairs is desirably a filament yarn. Examples of the material for the yarn include synthetic resins, such as nylon 6, nylon 12, polyester, acrylic, and vinylon resins. The yarn may be composed of such a resin kneaded with carbon or a metal powder, such as nickel powder, to enhance conductivity. Preferred are, for example, 3 to 7 denier brush fibers having a length of 2 to 5 mm, an electrical resistivity of $1\times10^{10}\Omega$ or less, a Young's modulus of 4900 to 9800 $N/mm^2$, and planted at a density (the number of brush fibers per unit area) of 50000 to 200000 fibers/square inch (50 k to 200 k fibers/$inch^2$), for example. The length of the brush roller 41 dragged on the photoreceptor is preferably 0.5 to 1.5 mm. The rotational speed of the brush roller 41 is 0.3 to 1.5 in terms of the circumferential speed ratio to that of the photoreceptor 1Y, for example. The brush roller 41 may rotate in the same rotational direction as that of the photoreceptor 1Y or the opposite direction thereof.

The pressurized spring 43 biases the lubricant stock 42 toward the photoreceptor 1Y such that the brush roller 41 applies a pressure of 0.5 to 1.0 N to the photoreceptor 1Y.

In the lubricant feeding unit 7Y, the pressure of the brush roller 41 applied by the lubricant stock 42 and the rotational speed of the brush roller 41 are adjusted such that the amount of the lubricant applied per $cm^2$ of the surface of the photoreceptor 1Y is $0.5\times10^{-7}$ to $1.5\times10^{-7}$ $g/cm^2$, for example.

In the configuration illustrated in FIG. 3, a blade 8Y is disposed at a position after the lubricant feeding unit 7Y and before the charging unit 2Y to homogeneously apply the lubricant fed by the lubricant feeding unit 7Y onto the surface of the photoreceptor 1Y.

Usable lubricants are fatty acid metal salts, such as zinc oleate, zinc stearate, and calcium stearate, for example. Among these salts, preferred is zinc stearate in view of lubrication and spread of the lubricant.

Although the exemplified imaging apparatus is configured to feed the lubricant through application of a solid lubricant by the brush roller, the lubricant can be fed by any method. The imaging apparatus may feed the lubricant in the form of a particulate lubricant externally added to a toner to the photoreceptor by the action of the development field formed during the developing step.

In this case, the particulate lubricant preferably has a number average primary particle size of 0.5 to 20 μm, for example. The particulate lubricant is preferably added in an amount of 0.01 to 0.3 mass % of the toner so as not to affect the charging characteristics of the toner.

Any particulate lubricant having lubrication and cleavage characteristics can be externally added to the toner. For example, zinc stearate and calcium stearate can be used.

The cleaning unit 6Y removes the residual toner on the surface of the photoreceptor 1Y. The exemplified cleaning unit 6Y is composed of a cleaning blade. The cleaning blade is composed of a support member 31, and a blade member 30 supported by the support member 31 with an interposed adhesive layer (not illustrated). The blade member 30 is disposed against the rotational direction of the photoreceptor 1Y (in the counter direction thereof) at the contact portion between the tip of the blade member 30 and the surface of the photoreceptor 1Y.

Any known support member 31 can be used. Examples thereof include those composed of rigid metals, elastic metals, plastics, and ceramics. Among these materials, preferred are rigid metals.

The blade member 30 has a multi-layer structure composed of a laminate of a base layer and an edge layer, for example. The base layer and the edge layer are preferably composed of polyurethane. Examples of the polyurethane include those prepared through a reaction of polyols, polyisocyanates, and an optional crosslinking agent.

In the imaging apparatus illustrated in FIG. 2, the photoreceptor 1Y, the charging unit 2Y, the developing unit 4Y, the lubricant feeding unit 7Y, and the cleaning unit 6Y are integrally supported, and are included as a process cartridge in the image forming unit 10Y. The process cartridge may be detachably attached to the body A of the imaging apparatus with a guiding unit, such as rails.

The image forming units 10Y, 10M, 10C, and 10Bk are vertically disposed in row. The intermediate transfer unit 70 is disposed on the left of the photoreceptors 1Y, 1M, 1C, and 1Bk in the diagram. The intermediate transfer unit 70 is composed of an intermediate transfer member 77 in the form of a semiconductive endless belt wound around a plurality of rollers 71, 72, 73, and 74 and rotatably supported by these rollers, a secondary transfer roller 5*b* as the secondary transfer unit, and a cleaning unit 6*b*.

The image forming units 10Y, 10M, 10C, and 10Bk and the intermediate transfer unit 70 are accommodated in a housing 80. The housing 80 can be drawn from the body A of the imaging apparatus through support rails 82L and 82R.

Examples of the fixing unit 24 include a heat roller fixing unit composed of a heating roller having an internal heat source, and a pressurized roller disposed in press contact with the heating roller so as to form a fixing nip.

Although the imaging apparatus according to the present invention has been illustrated as a color laser printer in FIG. 2, the imaging apparatus according to the present invention may be configured as a monochromatic laser printer or copier. The imaging apparatus according to the present invention can also include a light source for exposure other than lasers, such as LEDs.

Such an imaging apparatus including the photoreceptor according to the present invention including a protective layer containing the particulate P-type semiconductor and having a surface roughness Rz of 0.030 μm or more and 0.075 μm or less results in long-term stable cleaning characteristics which contribute to formation of highly stable quality of images.

[Process of Forming Image]

The process of forming an image according to the present invention is performed with the imaging apparatus according to the present invention to form an image. In detail, the surfaces of the photoreceptors 1Y, 1M, 1C, and 1Bk are negatively charged by the charging units 2Y, 2M, 2C, and 2Bk, respectively (charging). The surfaces of the photoreceptors 1Y, 1M, 1C, and 1Bk are exposed by the exposing units 3Y, 3M, 3C, and 3Bk based on the corresponding image signals to form electrostatic latent images, respectively (exposure). The surfaces of the photoreceptors 1Y, 1M, 1C, and 1Bk are developed with toners by the developing units 4Y, 4M, 4C, and 4Bk to form toner images, respectively (development).

The primary transfer rollers 5Y, 5M, 5C, and 5Bk are then brought into contact with the rotating intermediate transfer member 77. The toner images of the respective colors formed on the photoreceptors 1Y, 1M, 1C, and 1Bk are sequentially transferred onto the rotating intermediate transfer member 77 through contact between the primary transfer rollers 5Y, 5M, 5C, and 5Bk and the intermediate transfer member 77 to form color toner images on the intermediate transfer member 77 (primary transfer). The primary transfer roller 5Bk is always in contact with the photoreceptor 1Bk throughout image formation. The primary transfer rollers 5Y, 5M, and 5C are brought into contact with the photoreceptors 1Y, 1M, and 1C only during formation of the respective color toner images.

After the primary transfer rollers 5Y, 5M, 5C, and 5Bk are separated from the intermediate transfer member 77, a lubricant is fed to the surfaces of the photoreceptors 1Y, 1M, 1C, and 1Bk by the lubricant feeding units 7Y, 7M, 7C, and 7Bk (feeding of the lubricant). In the next step, the residual toners on the surfaces of the photoreceptors 1Y, 1M, 1C, and 1Bk are removed by the cleaning units 6Y, 6M, 6C, and 6Bk (cleaning). The surfaces of the photoreceptors 1Y, 1M, 1C, and 1Bk are optionally discharged by discharging units (not illustrated) for the next image formation.

As described above, the lubricant is fed to the surfaces of the photoreceptors 1Y, 1M, 1C, and 1Bk after each image formation in the imaging apparatus.

A transfer material P (such as a supporting medium carrying a final image, e.g., plain paper or a transparent sheet) accommodated in a sheet feeding cassette 20 is fed by the feeding unit 21 through a plurality of intermediate rollers 22A, 22B, 22C, and 22D and a resist roller 23 to a secondary transfer roller 5*b* as the secondary transfer unit. The secondary transfer roller 5*b* is brought into contact with the intermediate transfer member 77 to transfer the layered color toner images onto the transfer material P at a time. The transfer material P having the transferred color toner images is fixed by the fixing unit 24, and is discharged through discharging rollers 25 onto an external tray 26 for discharged sheets. The secondary transfer roller 5*b* is brought into contact with the intermediate transfer member 77 only during secondary transfer.

After the color toner images are transferred onto the transfer material P by the secondary transfer roller 5*b*, the transfer material P is separated through self stripping, and residual toners are removed from the intermediate transfer member 77 by the cleaning unit 6*b*.

Such a process of forming an image is performed with an imaging apparatus including the photoreceptor according to the present invention including a protective layer containing a particulate P-type semiconductor and having a surface roughness Rz of 0.030 μm or more and 0.075 μm or less results in long-term stable cleaning characteristics which contribute to formation of highly stable quality of images.

[Toner and Developer]

Any toner can be used in the imaging apparatus according to the present invention. A usable toner is a particulate toner containing a binder resin and a colorant. The particulate toner may contain other components, such as a mold release agent, when necessary.

The toner used can be either pulverized toners or polymerized toners. Preferred are polymerized toners in the imaging apparatus according to the present invention to provide high-quality images.

The toner preferably has an average volume median particle size of 2 to 8 μm. A toner having an average particle size within this range can increase resolution.

The particulate toner can contain appropriate amounts of externally additives, such as inorganic nanoparticles of silica and titania having an average particle size of about 10 to 300 nm, and a polisher having an average particle size of about 0.2 to 3 μm.

Although the toner can be used as a magnetic or non-magnetic one-component developer, the toner can also be used as a two-component developer in the form of a mixture with a carrier.

The toner used as a two-component developer can be mixed with a magnetic particulate carrier composed of a known material, such as a ferromagnetic metal, such as iron, an alloy of a ferromagnetic metal, aluminum, and lead, or a compound of ferromagnetic metals, such as ferrite and magnetite. Particularly preferred is ferrite.

Although the embodiment according to the present invention has been described in detail, the embodiment according to the present invention will not be limited to the above example, and can be modified in various ways.

EXAMPLES

The present invention will now be described in detail by way of non-limiting Examples.

Preparative Example 1 of Photoreceptor

(1) Preparation of Conductive Support

A drum-shaped aluminum support (outer diameter: 60 mm) was prepared as Conductive support [1].

(2) Formation of Intermediate Layer

A polyamide binder resin (100 parts by mass) for an intermediate layer was added to a mixed solvent (1700 parts by mass) of ethanol, n-propyl alcohol, and tetrahydrofuran (volume ratio: 45/20/35), and was mixed through stirring at 20° C. To the solution, titanium oxide particles "SMT500SAS" (made by Tayca Corporation, 160 parts by mass) and titanium oxide particles "SMT150MK" (made by Tayca Corporation, 120 parts by mass) were added, and were dispersed with a bead mill at a mill residence time of five hours. The solution was left to stand all night and all day, and was separated through filtration to prepare a coating solution for forming an intermediate layer. The solution was filtered through a Rigimesh filter (made by Pall Corporation) having a nominal filtration rating of 5 μm under a pressure of 50 kPa. The resulting coating solution for forming an intermediate layer was applied onto the cleaned outer peripheral surface of Conductive support [1] by an immersion process, and the coating was dried at 120° C. for 30 minutes to form Intermediate layer [1] having a dry thickness of 2 μm.

(3) Formation of Charge Generating Layer

The following raw materials were dispersed with a sand mill as a disperser for 10 hours to prepare Coating solution [1] for forming a charge generating layer:

| | |
|---|---|
| Charge generating material: a titanyl phthalocyanine pigment (having a maximum diffraction intensity at least at 27.3° in measurement of the Cu—Kα characteristic X ray diffraction spectrum) | 20 parts by mass |
| Binder resin for a charge generating layer: poly(vinyl butyral) resin "#6000-C" (made by DENKI KAGAKU KOGYO KABUSHIKI KAISHA) | 10 parts by mass |
| Solvent: t-butyl acetate | 700 parts by mass |
| Solvent: 4-methoxy-4-methyl-2-pentanone | 300 parts by mass |

Coating solution [1] for forming a charge generating layer was applied onto Intermediate layer [1] by an immersion process to form a coating. Charge generating layer [1] having a dry thickness of 0.3 μm was thereby formed.

(4) Formation of Charge Transporting Layer

The following raw materials were mixed, and were dissolved to prepare Coating solution [1] for forming a charge transporting layer:

| | |
|---|---|
| Charge transport material: 4,4'-dimethyl-4"-(β-phenylstyryl)triphenylamine) | 225 parts by mass |
| Binder resin for a charge transporting layer: polycarbonate resin "Z300" (made by MITSUBISHI GAS CHEMICAL COMPANY, INC.) | 300 parts by mass |
| Solvent: THF | 1600 parts by mass |
| Solvent: toluene | 400 parts by mass |
| Antioxidant (BHT) | 6 parts by mass |
| Silicone oil "KF-96" (made by Shin-Etsu Chemical Co., Ltd.) | 1 part by mass |

Coating solution [1] for forming a charge transporting layer was applied onto Charge generating layer [1] by an immersion process to form a coating. The coating was dried at 120° C. for 70 minutes to form Charge transporting layer [1] having a thickness of 20 μm.

(5) Formation of Protective Layer

A coating solution composition composed of

| | |
|---|---|
| Binder resin for a protective layer: polycarbonate resin "Z-300" (made by Toray Industries, Inc.) | 100 parts by mass |

-continued

| | |
|---|---|
| Surface-treated particulate P-type semiconductor ($CuAlO_2$, number average primary particle size: 50 nm) | 100 parts by mass |
| Solvent: 2-butanol | 330 parts by mass |
| Solvent: tetrahydrofuran | 17 parts by mass |

was sufficiently dissolved and dispersed with stirring to prepare Coating solution [1] for forming a protective layer.

Coating solution [1] for forming a protective layer was applied onto Charge transporting layer [1] with a circular slide hopper applicator provided with a circular forced exhaust apparatus, and the coating was dried at 120° C. for 70 minutes to form Protective layer [1] having a dry thickness of 3.0 μm and a surface roughness Rz of 0.05 μm. Photoreceptor [1] was thereby prepared.

Preparative Example 2 of Photoreceptor

Photoreceptor [2] was prepared as in Preparative Example 1 of photoreceptor except that the protective layer was formed as follows.

(5) Formation of Protective Layer

A coating solution composition composed of

| | |
|---|---|
| Polymerizable compound (Exemplified compound (M1)) | 100 parts by mass |
| Surface-treated particulate P-type semiconductor ($CuAlO_2$, number average primary particle size: 50 nm) | 100 parts by mass |
| Polymerization initiator "IRGACURE 819" made by BASF SE) | 5 parts by mass |
| Solvent: 2-butanol | 330 parts by mass |
| Solvent: tetrahydrofuran | 17 parts by mass |

was sufficiently dissolved and dispersed with stirring to prepare Coating solution [2] for forming a protective layer. Coating solution [2] for forming a protective layer was applied onto Charge transporting layer [1] with a circular slide hopper applicator provided with a circular forced exhaust apparatus. The coating was irradiated with ultraviolet light from a xenon lamp for one minute, and was dried at 120° C. for 70 minutes to form Protective layer [2] having a dry thickness of 3.0 μm and a surface roughness Rz of 0.05 μm. Photoreceptor [2] was thereby prepared.

Preparative Example 3 of Photoreceptor

Photoreceptor [3] was prepared as in Preparative Example 1 of photoreceptor except that the protective layer was formed as follows.

(5) Formation of Protective Layer

A coating solution composition composed of

| | |
|---|---|
| Polymerizable compound (Exemplified compound (M1)) | 100 parts by mass |
| Surface-treated particulate P-type semiconductor ($CuAlO_2$, number average primary particle size: 50 nm) | 100 parts by mass |
| Polymerization initiator: compound represented by Formula (A) | 5 parts by mass |
| Solvent: 2-butanol | 330 parts by mass |
| Solvent: tetrahydrofuran | 17 parts by mass |

was sufficiently dissolved and dispersed with stirring to prepare Coating solution [3] for forming a protective layer.

Coating solution [3] for forming a protective layer was applied onto Charge transporting layer [1] with a circular slide hopper applicator, and the coating was dried at 120° C. for 70 minutes to form Protective layer [3] having a dry thickness of 3.0 μm and a surface roughness Rz of 0.05 μm. Photoreceptor [3] was thereby prepared.

[Formula 3]

Formula (A)

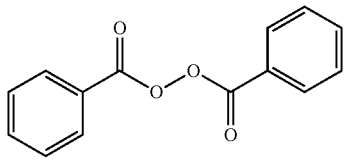

Preparative Examples 4 to 8 of Photoreceptors

Photoreceptors [4] to [8] were prepared as in Preparative Example 2 of photoreceptor except that the formula used in Formation of protective layer was varied as shown in Table 1.

Preparative Example 9 of Photoreceptor

Photoreceptor [9] was prepared as in Preparative Example 2 of photoreceptor except that the protective layer was prepared as follows.

(5) Formation of Protective Layer

A coating solution composition composed of

| | |
|---|---|
| Polymerizable compound (Exemplified compound (M1)) | 100 parts by mass |
| Surface-treated particulate P-type semiconductor ($CuAlO_2$, number average primary particle size: 100 nm) | 100 parts by mass |
| Polymerization initiator "IRGACURE 819" (made by BASF SE) | 5 parts by mass |
| Solvent: 2-butanol | 330 parts by mass |
| Solvent: tetrahydrofuran | 17 parts by mass |

was sufficiently dissolved and dispersed with stirring to prepare Coating solution [9] for forming a protective layer.

Coating solution [9] for forming a protective layer was applied onto Charge transporting layer [1] with a circular slide hopper applicator provided with a drying hood having a length of 200 mm. The coating was irradiated with ultraviolet light from a xenon lamp for one minute, and was dried at 120° C. for 70 minutes to form Protective layer [9] having a dry thickness of 3.0 μm and a surface roughness Rz of 0.08 μm. Photoreceptor [9] was thereby prepared.

Preparative Example 10 of Photoreceptor

Photoreceptor [10] was prepared as in Preparative Example 2 of photoreceptor except that the protective layer was formed as follows.

(5) Formation of Protective Layer

A coating solution composition composed of

| | |
|---|---|
| Polymerizable compound (Exemplified compound (M1)) | 100 parts by mass |
| Surface-treated particulate P-type semiconductor ($CuAlO_2$, number average primary particle size: 20 nm) | 80 parts by mass |
| Polymerization initiator "IRGACURE 819" (made by BASF SE) | 5 parts by mass |
| Solvent: 2-butanol | 230 parts by mass |
| Solvent: tetrahydrofuran | 12 parts by mass |

was sufficiently dissolved and dispersed with stirring to prepare Coating solution [10] for forming a protective layer. Coating solution [10] for forming a protective layer was applied onto Charge transporting layer [1] with a circular slide hopper applicator provided with a circular forced exhaust apparatus. The coating was irradiated with ultraviolet light from a xenon lamp for one minute, and was dried at 120° C. for 70 minutes to form Protective layer [10] having a dry thickness of 3.0 μm and a surface roughness Rz of 0.022 μm. Photoreceptor [10] was thereby prepared.

Preparative Examples 11 and 12 of Photoreceptors

Photoreceptors [11] and [12] were prepared as in Preparative Example 2 of photoreceptor except that the formula used in Formation of protective layer was varied as shown in Table 1.

In the lubricant applying mechanism, a solid lubricant composed of zinc stearate was used, and the amount of the lubricant applied per $cm^2$ of the surface of the photoreceptor was adjusted to $1.0\times10^{-7}$ g/$cm^2$.

(1) Evaluation of Fogging

After the print durability test, a transfer material "POD Gross Coat" (size A3, 100 g/$m^2$) (made by Oji Paper Co., Ltd.) having no image formed was transported to the black developing unit, and a plain image (white solid image) was formed at a grid voltage of −800 V and a developing bias of −650 V. The fogging density was measured in a non-image portion of the transfer material after the plain image was formed. In detail, the absolute image density was measured in any 20 places of the transfer material having no image formed (blank paper) to calculate an average D1. The absolute image density was measured in any 20 places of the non-image portion of the transfer material after formation of the plain image to calculate an average D2. The fogging density was calculated by an expression of (D2−D1). The absolute image density was measured with a Macbeth densitometer "RD-918" (made by Gretag Macbeth GmbH). The fogging density was evaluated according to the following criteria. The results are shown in Table 2.

—Criteria for Evaluation—

A: Good (acceptable): a fogging density of 0.006 or less.

B: Non-problematic in normal use (acceptable): a fogging density of more than 0.006 and 0.010 or less.

TABLE 1

| | | Binder resin for protective layer | | Particulate P-type semiconductor | | | | | | |
|---|---|---|---|---|---|---|---|---|---|---|
| | Photo-receptor No. | Type of polymerizable compound | Amount (parts by mass) | Type | Number average primary particle size [nm] | Amount (parts by mass) | Curing process | Surface rough-ness Rz [μm] | Universal hardness [N/$mm^2$] | Lubri-cant |
| Example 1 | [1] | Polycarbonate resin | 100 | $CuAlO_2$ | 50 | 100 | — | 0.05 | 190 | Fed |
| Example 2 | [2] | Exemplified compound (M1) | 100 | $CuAlO_2$ | 50 | 100 | Light | 0.05 | 280 | Fed |
| Example 3 | [3] | Exemplified compound (M1) | 100 | $CuAlO_2$ | 50 | 100 | Heat | 0.05 | 280 | Fed |
| Example 4 | [4] | Exemplified compound (M2) | 100 | $CuInO_2$ | 20 | 200 | Light | 0.03 | 330 | Fed |
| Example 5 | [5] | Exemplified compound (M13) | 100 | $Cu_2O$ | 50 | 150 | Light | 0.06 | 320 | Fed |
| Example 6 | [6] | Exemplified compound (M1) | 100 | $SrCu_2O_2$ | 50 | 150 | Light | 0.075 | 240 | Fed |
| Example 7 | [7] | Exemplified compound (M1) | 100 | $CuAlO_2$ | 50 | 150 | Light | 0.04 | 300 | Fed |
| Example 8 | [8] | Exemplified compound (M4) | 100 | $CuAlO_2$ | 50 | 100 | Light | 0.03 | 210 | Fed |
| Comparative Example 1 | [9] | Exemplified compound (M1) | 100 | $CuAlO_2$ | 100 | 100 | Light | 0.03 | 280 | Fed |
| Comparative Example 2 | [10] | Exemplified compound (M1) | 100 | $CuAlO_2$ | 20 | 80 | Light | 0.023 | 300 | Fed |
| Comparative Example 3 | [11] | Exemplified compound (M1) | 100 | ($SnO_2$) | 20 | 100 | Light | 0.04 | 300 | Fed |
| Comparative Example 4 | [12] | Exemplified compound (M1) | 100 | $CuAlO_2$ | 20 | 100 | Light | 0.05 | 280 | Not fed |

Examples 1 to 8, Comparative Examples 1 to 3

Photoreceptors [1] to [11] were mounted on an imaging apparatus "bizhub PRO C1070" having a lubricant applying mechanism (made by KONICA MINOLTA, INC.), and were evaluated.

A print durability test was performed under an environment at a temperature of 23° C. and a humidity of 50% RH. In the test, an image of bands having an image area ratio of 5% was continuously printed on two sides of 1000000 sheets fed in an A4 long edge feeding mode. After this test, fogging, striations, and blurring of images were evaluated.

C: Problematic in practical use (unacceptable): a fogging density of more than 0.010.

(2) Evaluation of Striations of Images

After the print durability test, an additional print durability test was performed under an environment at a temperature of 30° C. and a humidity of 80% RH. In the test, an image of characters having an image area ratio of 6% was continuously printed on one sides of 500000 sheets fed in an A4 long edge feeding mode. After the additional print durability test, a black halftone image was output. The black halftone image was visually observed to evaluate striations in the image (FD striations) caused by scratches on the surface of the photoreceptor. The results are shown in Table 2.

—Criteria for Evaluation—

A: Good (acceptable): a halftone image without striations.

B: Non-problematic for practical use (acceptable): a rough halftone image without striations.

C: Unacceptable: a halftone image with striations.

(3) Blurring of Images

After the print durability test, an additional print durability test was performed under an environment at a temperature of 30° C. and a humidity of 80% RH. In the test, an image of characters having an image area ratio of 6% was continuously printed on one sides of 500000 sheets fed in an A4 long edge feeding mode. Immediately after this additional print durability test, the main power supply of the imaging apparatus was turned off. The main power supply was turned on after 12 hours, and a halftone image having a relative reflection density of 0.4 was output over the entire surface of size A3 neutralized paper immediately after the apparatus was ready to accept print job. A six-dot lattice image was also output over the entire surface of size A3 neutralized paper. These images were visually observed to evaluate blurring of the images. The results are shown in Table 2.

—Criteria for Evaluation—

A: Good (acceptable): a halftone image and a lattice image without blurring.

B: Non-problematic for practical use (acceptable): only a halftone image having low-density strips in the axial direction of the photoreceptor.

C: Unacceptable: a lattice image having hollow portions or reduced line widths caused by blurring of the image.

Comparative Example 4

Photoreceptor [12] was mounted on an imaging apparatus "bizhub PRO C1070" (made by KONICA MINOLTA, INC.) having a lubricant applying mechanism, and was evaluated as in Example 1 except that the lubricant applying mechanism was not operated.

Examples 9 and 10

Photoreceptors [1] and [2] were each mounted on an imaging apparatus "bizhub PRO C1070" (made by KONICA MINOLTA, INC.) having a lubricant applying mechanism, and were evaluated as in Example 1 except that the lubricant applying rod was removed, and 0.1 mass % zinc stearate nanoparticles having a number average primary particle size of 1 μm were externally added to the particulate toner used as a developer in Examples 1 to 8 and Comparative Examples 1 to 3.

TABLE 2

| | Photo-receptor No. | Results | | |
|---|---|---|---|---|
| | | Striations in image (FD striations) | Blurring of image | Fogging |
| Example 1 | [1] | B | A | A |
| Example 2 | [2] | A | A | A |
| Example 3 | [3] | A | A | A |
| Example 4 | [4] | A | A | B |

TABLE 2-continued

| | Photo-receptor No. | Results | | |
|---|---|---|---|---|
| | | Striations in image (FD striations) | Blurring of image | Fogging |
| Example 5 | [5] | A | A | A |
| Example 6 | [6] | A | A | A |
| Example 7 | [7] | A | A | A |
| Example 8 | [8] | A | A | A |
| Example 9 | [1] | B | A | A |
| Example 10 | [2] | A | A | A |
| Comparative Example 1 | [9] | C | C | C |
| Comparative Example 2 | [10] | C | B | B |
| Comparative Example 3 | [11] | C | B | C |
| Comparative Example 4 | [12] | C | B | B |

The entire disclosure of Japanese Patent Application No. 2015-069055 filed on Mar. 30, 2015 including description, claims, drawings, and abstract are incorporated herein by reference in its entirety.

What is claimed is:

1. An imaging apparatus comprising:

an electrophotographic photoreceptor;

a charging unit to charge the surface of the electrophotographic photoreceptor, wherein the charging unit is disposed so as not to be in contact with the electrophotographic photoreceptor;

an exposing unit to perform exposure of the electrophotographic photoreceptor charged by the charging unit;

a developing unit to feed a toner to the electrophotographic photoreceptor exposed by the exposing unit to form a toner image;

a transfer unit to transfer the toner image formed on the electrophotographic photoreceptor;

a lubricant feeding unit to feed a lubricant onto the surface of the electrophotographic photoreceptor, wherein the lubricant contains a fatty acid metal salt; and a cleaning unit to remove the residual toner on the surface of the electrophotographic photoreceptor, wherein the electrophotographic photoreceptor comprises a conductive support, a photoreceptive layer, and a protective layer disposed in sequence, the protective layer comprises a resin containing a particulate P-type semiconductor, the particulate P-type semiconductor a metal oxide nanoparticle, and the protective layer has a surface roughness Rz of 0.030 μm or more and 0.075 μm or less.

2. The imaging apparatus according to claim 1, wherein the resin forming the protective layer is a curable resin prepared through a polymerization reaction of a crosslinkable polymerizable compound, and the protective layer has a universal hardness of 200 $N/mm^2$ or more and 320 $N/mm^2$ or less.

3. The imaging apparatus according to claim 1, wherein the particulate P-type semiconductor consists of $CuAlO_2$.

4. The imaging apparatus according to claim 1, wherein the lubricant feeding unit comprises a solid lubricant and a lubricant applying member.

5. The imaging apparatus according to claim 1, wherein the lubricant consists of a fatty acid metal salt.

6. An imaging apparatus comprising:

an electrophotographic photoreceptor;

a charging unit to charge the surface of the electrophotographic photoreceptor, wherein the charging unit is disposed so as not to be in contact with the electrophotographic photoreceptor;

an exposing unit to perform exposure of the electrophotographic photoreceptor charged by the charging unit;

a developing unit to feed a toner having an externally added lubricant to the electrophotographic photoreceptor exposed by the exposing unit to form a toner image, wherein the lubricant contains a fatty acid metal salt;

a transfer unit to transfer the toner image onto the electrophotographic photoreceptor; and a cleaning unit to remove the residual toner on the surface of the electrophotographic photoreceptor, wherein the electrophotographic photoreceptor comprises a conductive support, a photoreceptive layer, and a protective layer disposed in sequence, the protective layer comprises a resin containing a particulate P-type semiconductor, the particulate P-type semiconductor is a metal oxide nanoparticle, and the protective layer has a surface roughness Rz of 0.030 μm or more and 0.075 μm or less.

7. The imaging apparatus according to claim 6, wherein the resin forming the protective layer is a curable resin prepared through a polymerization reaction of a crosslinkable polymerizable compound, and the protective layer has a universal hardness of 200 $N/mm^2$ or more and 320 $N/mm^2$ or less.

8. The imaging apparatus according to claim 6, wherein the particulate P-type semiconductor consists of $CuAlO_2$.

9. The imaging apparatus according to claim 6, wherein the lubricant comprises zinc stearate.

10. A process of forming an image, comprising the steps of:

charging the surface of an electrophotographic photoreceptor with a charging unit, wherein the charging unit is disposed so as not to be in contact with the electro photographic photoreceptor;

performing exposure of the charged electrophotographic photoreceptor;

feeding a toner to the exposed electrophotographic photoreceptor to form a toner image;

transferring the toner image formed on the electrophotographic photoreceptor;

feeding a lubricant onto the surface of the electrophotographic photoreceptor, wherein the lubricant contains a fatty acid metal salt; and removing the residual toner on the surface of the electrophotographic photoreceptor, wherein the electrophotographic photoreceptor comprises a conductive support, a photoreceptive layer, and a protective layer disposed in sequence, the protective layer comprises a resin containing a particulate P-type semiconductor, the particulate P-type semiconductor is a metal oxide nanoparticle, and the protective layer has a surface roughness Rz of 0.030 μm or more and 0.075 μm or less.

11. The process of forming an image according to claim 10, wherein in the step of feeding the lubricant, a particulate lubricant externally added to the toner is fed to the electrophotographic photoreceptor by the action of the development field formed during the feeding of the toner.

12. The process of forming an image according to claim 10, wherein the resin forming the protective layer is a curable resin prepared through a polymerization reaction of a crosslinkable polymerizable compound, and the protective layer has a universal hardness of 200 $N/mm^2$ or more and 320 $N/mm^2$ or less.

13. The process of forming an image according to claim 10, wherein the particulate P-type semiconductor consists of $CuAlO_2$.

14. The process of forming an image according to claim 10, wherein the lubricant comprises zinc stearate.

* * * * *